United States Patent [19]

Rokop

[11] Patent Number: 4,903,752

[45] Date of Patent: Feb. 27, 1990

[54] HOT METAL SUPPLY FOR CONTINUOUS CASING AND THE LIKE

[75] Inventor: Joseph Rokop, Pittsburgh, Pa.

[73] Assignee: Rokop Corporation, Pittsburgh, Pa.

[21] Appl. No.: 230,626

[22] Filed: Aug. 10, 1988

[51] Int. Cl.[4] ..... B22D 11/10

[52] U.S. Cl. ..... 164/488; 222/590

[58] Field of Search ..... 164/133, 337, 437, 488; 222/590, 597

[56] References Cited

U.S. PATENT DOCUMENTS 3,583,470 6/1971 Bohler ..... 164/488

3,741,277 6/1973 Bachner et al. ..... 164/488

*Primary Examiner*—Richard K. Seidel

*Attorney, Agent, or Firm*—Walter J. Blenko, Jr.

[57] ABSTRACT

Continuous casting apparatus and the like in which at least one tundish is provided to receive hot metal from a ladle. Two ladles are provided, each ladle being arranged for horizontal movement between positions above the tundishes and to one side of the tundishes. Stoppers are located in the ladle bottoms adjacent the outer edge so that two ladles can be simultaneously positioned over one tundish.

3 Claims, 3 Drawing Sheets

HOT METAL SUPPLY FOR CONTINUOUS CASING AND THE LIKE

This application relates to supplying hot metal for continuous casting and the like. More particularly, this invention relates to supplying hot metal from a ladle to a tundish and then from the tundish to a continuous caster and the like.

In the operation of continuous casting machines and other like apparatus, it is common to provide a tundish from which hot metal is discharged to the continuous caster and the like. My invention is not limited to use with continuous casting machines but may also be used with other types of metal forming apparatus in which a tundish is provided to permit a controlled flow of hot metal into the apparatus. I refer to such apparatus herein as continuous casting apparatus and intend use of such terminology to include such other types of apparatus and processes.

In the use of a tundish with a continuous caster, certain problems may be encountered. The usual practice is to feed hot metal to the tundish from a ladle which is positioned above the tundish. Hot metal is discharged from the ladle to the tundish as needed by opening and closing the ladle stopper. When the ladle is emptied, it is necessary to remove the ladle and to replace it with a full ladle. During that time, the level of metal in the tundish will fall as hot metal flows through the tundish nozzles, possibly causing inclusions or slag entrapment in the strand being cast. Heat loss may tend to cause freezing of the metal in the tundish nozzle as the metal in the ladle is exhausted. To avoid freezing in the tundish as the level of hot metal in the ladle falls, it may be necessary to provide a full ladle with metal which is hotter than desired leading to higher than desired metal temperature at the tundish nozzle as the full ladle is teemed into the tundish.

I provide continuous casting apparatus having a tundish, a first ladle horizontally movable to and away from a position above the tundish. I provide stopper means adjacent the outer edge of the bottom of the ladle whereby the stopper can be positioned above the tundish while only a part of the ladle is above the tundish. I provide a second ladle having stopper means positioned adjacent the outer edge of the bottom of the ladle. I prefer to teem hot metal from the first ladle into the tundish. As the level in the first ladle drops, I position the second ladle full of hot metal above the tundish. I may blend the metal from the two ladles into the tundish to obtain a desired average temperature in the tundish As the first ladle empties, I continue to supply hot metal from the second ladle while the first ladle is refilled whereupon the process is repeated alternately refilling one ladle then the other.

In one form of the invention, two separate tundishes may be provided aligned on a single horizontal axis. Stoppers are provided on opposite edges of each ladle whereby hot metal may be provided to one or both tundishes by moving the ladles to positions where the stoppers are over one or both tundishes.

Other details, objects and advantages of the invention will become more apparent as the following description of a present preferred embodiment of the invention proceeds.

In the accompanying drawings, I have illustrated a present preferred embodiment of my invention in which FIG. 1 is a front elevation view of continuous casting apparatus embodying the invention;

Figure 1:
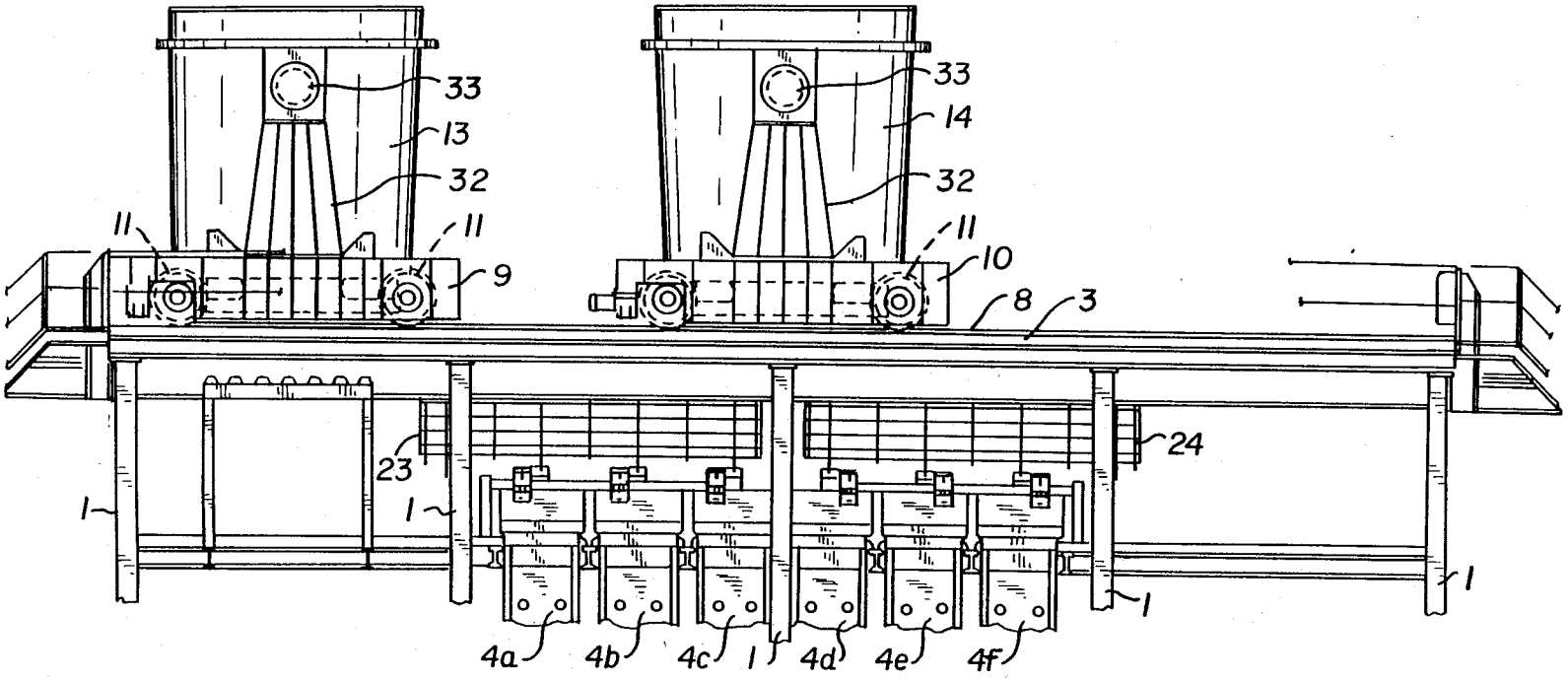
Figure 2:
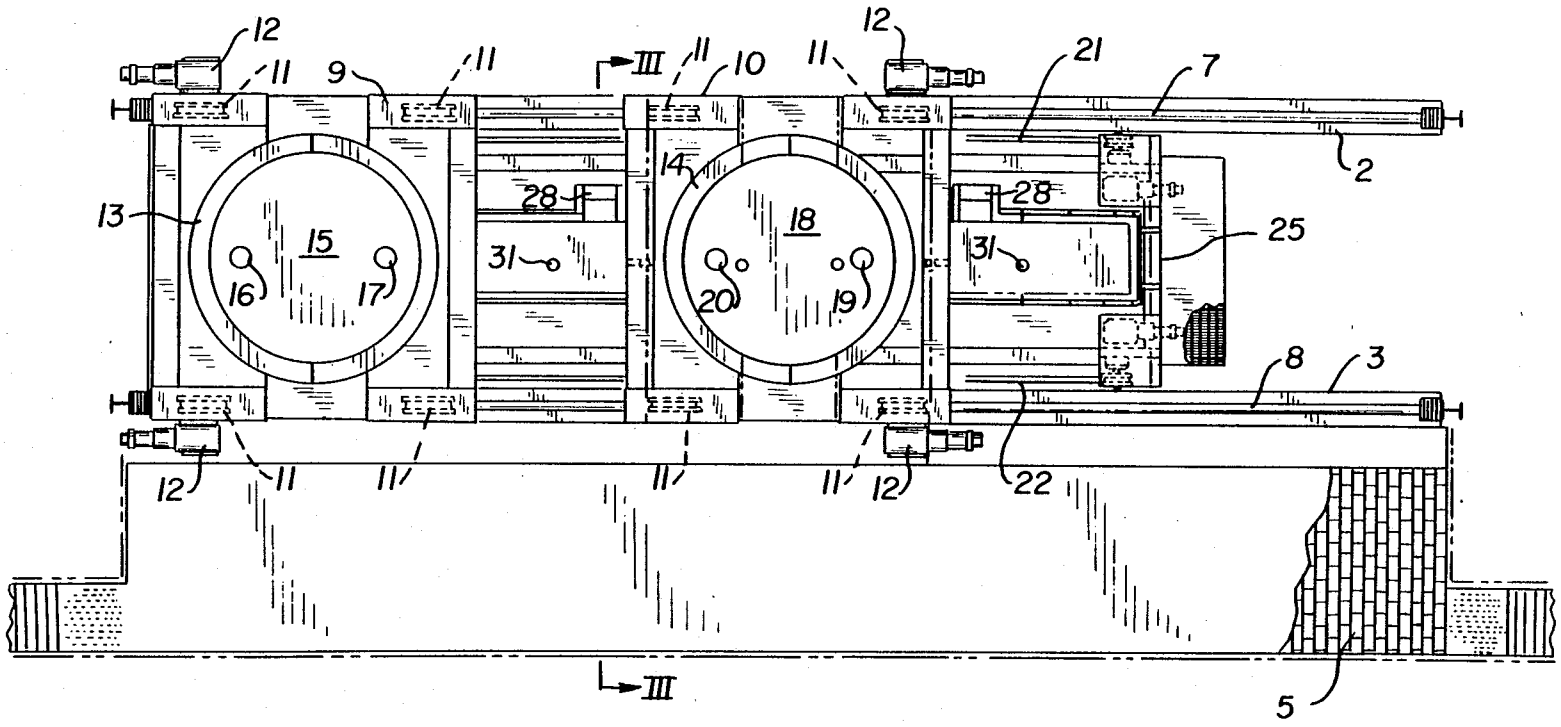
FIG. 2 is a top plan view of the apparatus shown in FIG. 1.
Figure 3:
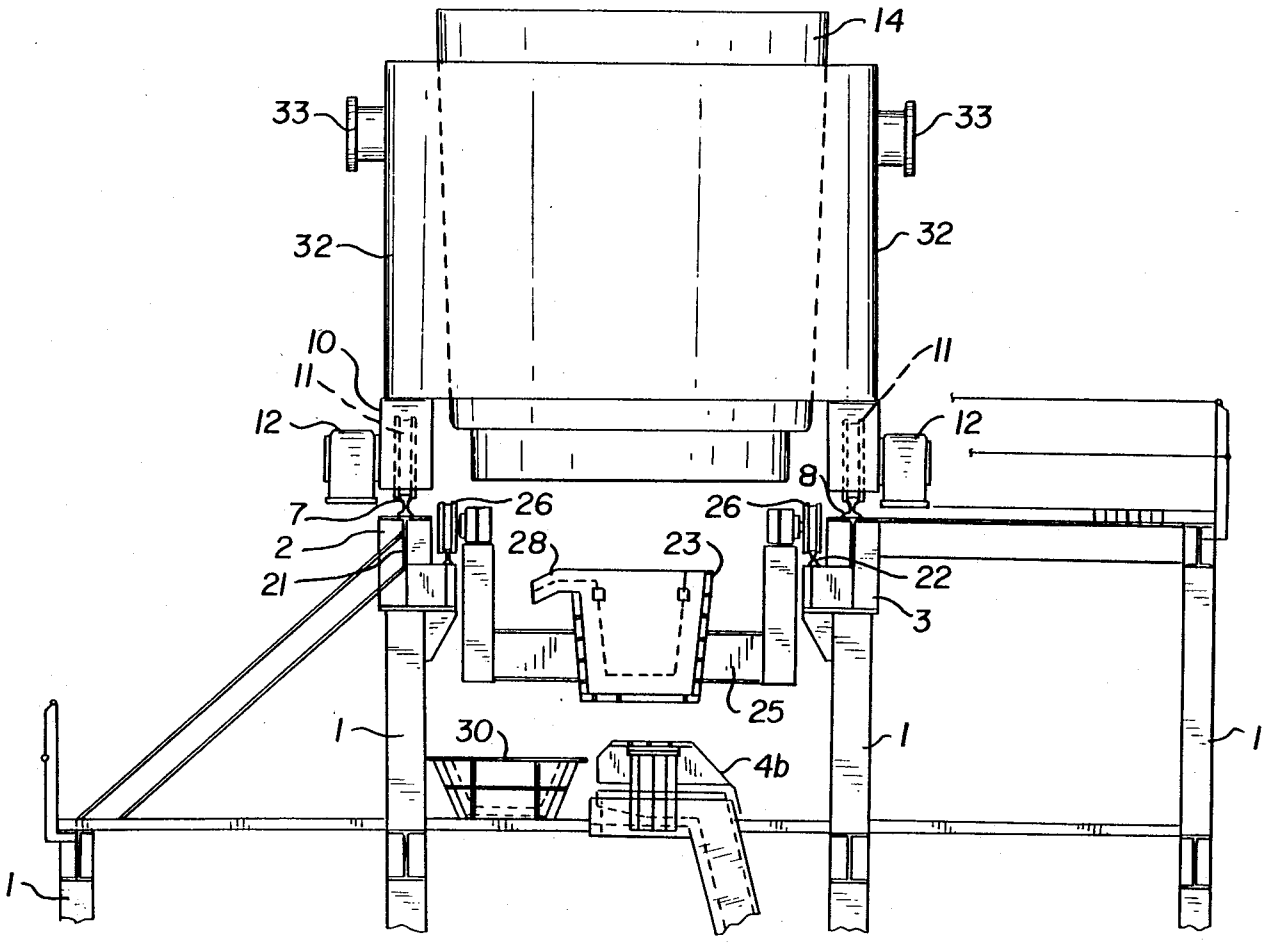
FIG. 3 is an end sectional view of the apparatus shown in FIG. 1 taken along lines 3—3 of FIG. 2.

The hot metal handling apparatus is mounted on a structural steel framework. The framework comprises a plurality of columns 1 and beams including ladle and tundish support beams 2 and 3 which extend from one end of the structure to the other. The upper portion of a six-strand continuous caster is shown in the drawings with the strand molds being identified as 4a, 4b, 4c, 4d, 4e, and 4f. A platform 5 is provided at the ladle level and an additional platform 6 may be provided at the caster level. Ladle car rails 7 and 8 are mounted on beams 2 and 3 respectively. A ladle car 9 and a second ladle car 10 are mounted on flanged wheels 11 which travel on rails 2 and 3. A pair of drive units 12 is mounted at one end of each ladle car. Each drive unit comprises a motor and reduction gearing which is connected to the adjacent wheel 11. Ladles 13 and 14 are mounted on ladle cars 9 and 10 respectively. The bottom surface 15 of ladle 13 is provided with two stoppers 16 and 17. Each stopper is positioned on an axis parallel to the axes of rails 7 and 8 and each stopper is positioned near the circumferential outer edge of bottom 15. In the same manner, bottom 18 of ladle 14 is provided with stoppers 19 and 20 which are aligned on an axis parallel to the axes of rails 7 and 8 and are located adjacent the circumferential outer edge of bottom 18.

Tundish rails 21 and 22 are mounted on beams 2 and 3, respectively, between and below ladle rails 7 and 8. Tundishes 23 and 24 are mounted between and below rails 21 and 22. Each end of tundishes 23 and 24 is supported by a framework 25 which is carried by flanged wheels 26 that travel on rails 21 and 22. Wheels 26 are driven by drive units 27 comprising a motor and gearbox. The pair of frameworks provided at opposite ends of the tundishes comprises a tundish carrier. The frameworks have been omitted from FIG. 1 for clarity of illustration. An overflow 28 is provided from tundish 23 and an overflow 29 is provided from tundish 24. In the event that the tundishes should be overfilled with hot metal, e.g., as a result of a running stopper in one of the ladles, excess metal will overflow at 28 or 29. Metal which may overflow from overflows 28 and 29 will fall into a runner 30 which conducts hot metal to a collecting ladle which is not shown in the drawings. Nozzles 31 are provided in the bottom of each tundish positioned to discharge metal into the molds of the continuous casting apparatus.

Each ladle is provided with a pair of pedestals 32 on each side. The pedestals rest on the ladle car and transfer the weight of the ladle to the ladle car. Trunions 33 are provided on each pedestal by which the ladle can be lifted from the ladle car by a crane.

In the drawings, ladle 14 is shown in position partly over tundish 23 and partly over tundish 24. Stoppers 19 and 20 will be opened and closed as required to permit hot metal to flow into each tundish to an extent necessary to maintain the hot metal at a proper level within each tundish. Ladle car 9 has been moved to a position at the ends of rails 7 and 8 where it is not above either tundish. When the car is in that position, a full ladle 13 is moved by crane and positioned on ladle car 9 Next ladle car 9 is moved to a position in which stopper 17 is positioned above tundish 23. Hot metal from ladle 14 may also be introduced into tundish 23 so that the temperature of metal in ladles 13 and 14 will be blended in tundish 23 to achieve a desired operating temperature.

Ladle car 10 may be moved to the right, as viewed in FIG. 1, until stopper 19 is above tundish 24. Hot metal may be added to tundish 24 from ladle 14 until ladle 14 is empty. If desired, ladle car 9 may be moved so that stopper 17 of ladle 13 is above tundish 24 so that metal from ladle 13 and ladle 14 may be blended in tundish 24.

When ladle 14 has become empty, ladle car 10 is moved to the right (as viewed in FIG. 1) and hot metal is supplied to tundishes 23 and 24 from ladle 13 only. Meanwhile, ladle 14 is lifted from the ladle car by a crane and is replaced with a full ladle or it may be taken to a furnace for refilling. When ladle 14 full of hot metal is returned to ladle car 10, the process just described is repeated recognizing, however, that now ladle 14 is the ladle which is full of metal of higher temperature than the partial load of metal in ladle 13.

In the event that tundish replacement is required, either tundish 23 or 24 may be shifted upon its associated tundish carrier to a position where it is not above the continuous caster strands. The tundish can be readily removed from the carrier framework and another tundish inserted in its place.

While I have illustrated and described a present preferred embodiment of my invention, it is to be understood that I do not limit myself thereto and that my invention may be otherwise variously practiced within the scope of the following claims.

I claim:

1. A method of supplying hot metal to a continuous casting machine which comprises providing a tundish from which hot metal flows to the continuous casting machine, positioning a first ladle containing hot metal above said tundish, discharging hot metal from the first ladle to said tundish, positioning a second ladle containing hot metal above said tundish while the first ladle is discharging hot metal into said tundish, commencing discharge of hot metal from the second ladle to said tundish as the first ladle empties, and repeating the steps whereby an uninterrupted flow of hot metal is maintained from the ladles to said tundish.

2. The method of claim 1 in which two ladles are alternately emptied and refilled.

3. The method of claim 1 in which hot metal from a full ladle is discharged into the tundish and is blended in the tundish with hot metal from a ladle which is emptying.

* * * * *

Disclaimer 4,903,752.—*Joseph Rokop*, Pittsburg, Pa. HOT METAL SUPPLY FOR CONTINUOUS CASING AND THE LIKE. Patent dated Feb. 27, 1990. Disclaimer filed Mar. 30, 1990, by the assignee, Rokop Corp.

Hereby enters this disclaimer to claims 1, 2 and 3 of said patent.

[ *Official Gazette June 26, 1990* ]